US011585512B2

(12) United States Patent
Stadler et al.

(10) Patent No.: US 11,585,512 B2
(45) Date of Patent: Feb. 21, 2023

(54) HEAT SINK FOR A MOTOR VEHICLE LIGHT MODULE

(71) Applicant: ZKW Group GmbH, Wieselburg (AT)

(72) Inventors: Peter Stadler, Raxendorf (AT); Manuel Fahrngruber, Petzenkirchen (AT); Clemens Hauer, Steinakirchen am Forst (AT)

(73) Assignee: ZKW Group GmbH, Wieselburg (AT)

( * ) Notice: Subject to any disclaimer, the term of this patent is extended or adjusted under 35 U.S.C. 154(b) by 0 days.

(21) Appl. No.: 17/299,286

(22) PCT Filed: Nov. 27, 2019

(86) PCT No.: PCT/EP2019/082736
§ 371 (c)(1),
(2) Date: Jun. 2, 2021

(87) PCT Pub. No.: WO2020/114859
PCT Pub. Date: Jun. 11, 2020

(65) Prior Publication Data

US 2022/0049832 A1 Feb. 17, 2022

(30) Foreign Application Priority Data

Dec. 4, 2018 (EP) ..... 18210206

(51) Int. Cl.
*F21V 29/75* (2015.01)
*F21S 45/47* (2018.01)

(52) U.S. Cl.
CPC ..... *F21S 45/47* (2018.01)

(58) Field of Classification Search
CPC ..... F21S 45/47; F21S 41/153; F21V 29/763; F21V 29/713; F21V 29/75; B23P 11/005
(Continued)

(56) References Cited

U.S. PATENT DOCUMENTS

2009/0194251 A1 8/2009 Wei
2010/0181046 A1 7/2010 Chen
(Continued)

FOREIGN PATENT DOCUMENTS

DE 202018100769 U1 * 6/2019 ..... F21S 41/192
EP 2770253 A1 8/2014

OTHER PUBLICATIONS

International Search Report for PCT/EP2019/082736, dated Feb. 5, 2020 (12 pages).

(Continued)

*Primary Examiner* — Omar Rojas Cadima
(74) *Attorney, Agent, or Firm* — Eversheds Sutherland (US) LLP

(57) ABSTRACT

The invention relates to a heat sink (1, 100) for a light source of a motor vehicle light module, wherein: the heat sink (1, 100) comprises a main body (2) and cooling plates (3, 300) which can be arranged on the main body (2); when the cooling plates (3, 300) are connected to the main body (2), the cooling plates (3, 300) are in heat-conducting contact with the main body (2), each cooling plate (3, 300) having a base side (31, 310); the main body (2) has fastening elements (21) on a surface (22), the surface (22) facing the base sides (31, 310) of the cooling plates (3, 300); counter elements (32) mating with the fastening elements (21) are arranged on each base side (31, 310), the fastening elements (21) being designed to engage in the counter elements (32); the fastening elements (21) are arranged in a grid (23); the counter elements (32) are arranged on the respective base sides (31, 310) at regular distances (d1) from one another, and the grid (23) has a grid spacing (d2), the grid spacing (d2) being greater than the distance (d1) between the counter elements (32).

14 Claims, 2 Drawing Sheets

(58) Field of Classification Search
USPC ..... 362/294, 373; 257/23.103; 165/80.3
See application file for complete search history.

(56) References Cited

U.S. PATENT DOCUMENTS

| | | | |
|---|---|---|---|
| 2012/0325430 | A1 | 12/2012 | Shih-Ming et al. |
| 2013/0299154 | A1 | 11/2013 | Sheng-Huang et al. |
| 2018/0058657 | A1 | 3/2018 | Duarte et al. |

OTHER PUBLICATIONS

Search Report for European U.S. Appl. No. 18/210,206, dated Mar. 3, 2019 (10 pages).

* cited by examiner

HEAT SINK FOR A MOTOR VEHICLE LIGHT MODULE

The invention relates to a heat sink for at least one light source of a motor vehicle light module, preferably of a motor vehicle headlamp light module, wherein the heat sink comprises a base body and cooling plates that can be arranged and preferably are arranged on the base body, wherein the cooling plates, which are preferably made from metal such as aluminium, are set up to be in thermally conductive contact with the base body, wherein each cooling plate has a base side, wherein the base body has fastening elements on a surface, wherein the surface faces the base sides of the cooling plates, wherein counterpart elements, which correspond to the fastening elements, are arranged on each base side, wherein the fastening elements are constructed to engage into the counterpart elements.

The expression that the cooling plates are set up to be in thermally conductive contact with the base body means that the cooling plates are in thermally conductive contact with the base body when they are arranged on the base body or connected to the base body.

Furthermore, the invention relates to a motor vehicle light module or motor vehicle headlamp light module having at least one previously mentioned heat sink.

Furthermore, the invention relates to a motor vehicle headlamp having at least one such motor vehicle light module or motor vehicle headlamp light module.

Heat sinks of the above-mentioned type are known from the prior art. Often, heat sinks of this type are used as a fundamental component of a motor vehicle light module or a motor vehicle headlamp light module. In a light module of this type, the heat sink is used as the support of a light source and dissipates the heat from the same when the light source is operating.

Installation spaces that are available for a light module in a motor vehicle or in a motor vehicle headlamp are very strongly dependent on the model of the motor vehicle and the motor vehicle headlamp. It is known that various motor vehicle producers use very differently configured motor vehicle headlamps.

Thus, it is very difficult to install one and the same heat sink in motor vehicle light modules or motor vehicle headlamp light modules of different motor vehicle producers. As a result, there is a very stark increase in both the number of differently configured heat sinks that are to be developed and the costs.

It is the object of the present invention to overcome the above-mentioned disadvantages of the prior art and provide a heat sink, the shape of which can be varied and can be adapted to the predetermined contours of a motor vehicle light module or motor vehicle headlamp.

This object is achieved according to the invention with a heat sink of the previously mentioned type in that the fastening elements are arranged in a matrix, wherein the counterpart elements are arranged on the respective base sides at regular spacings from one another and the matrix has a matrix spacing, wherein the matrix spacing is greater than the spacing between the counterpart elements.

Thus, the number of arrangement options of the cooling plates on the base body is increased. In particular, different cooling plates, which are constructed separately from one another for example, can be fastened in different positions on the cooling body. To this end, the base sides in particular are constructed separately from one another. In other words, the individual cooling plates are not constructed in one piece with one another, but rather as individual parts, which are separate from one another. This results in the advantage that the individual cooling plates can be fastened at various positions relative to one another on the surface of the heat sink. In other words, the individual cooling plates can be arranged or fastened on the surface of the heat sink offset with respect to one another in one direction, preferably in two directions, along the surface.

Thus, the cooling plates can be fastened on the heat sink in accordance with a spatial delimitation or requirement due to the shape of the motor vehicle light module. As a result, it is possible to mount the cooling plates at various positions on the base body and thus to install the base body in various installation-space situations. The base bodies and the cooling plates may for example always stay the same, which lowers the production costs.

In connection with the present invention, the term "arranged in a matrix" is understood to mean a matrix-array-like arrangement, for example an arrangement in vertices of an imaginary two-dimensional, preferably regular, particularly square grid.

It may advantageously be provided that the base sides lie in a plane arranged parallel to the surface of the base body.

It may be expedient if the fastening elements and/or the counterpart elements are constructed identically.

Furthermore, an advantage may result if the counterpart elements are arranged in a row, which preferably extends along the longitudinal direction of the base side.

It may be provided in a particularly preferred embodiment that each cooling plate is constructed in a U-shaped manner and has a pair of legs, which run substantially parallel to one another at a mutual spacing and are connected by a connecting web, wherein the connecting web forms the base side.

Furthermore, it may be provided that each cooling plate is constructed in an L-shaped manner, wherein the base side is formed by a short side of the L-shaped cooling plate.

Further advantages result if the spacing between the counterpart elements is the same for all cooling plates and is preferably approximately half of the matrix spacing. As a result, many more variants can also be realized using one and the same heat sink and cooling plates.

It may be expedient if all cooling plates are constructed identically.

It may be provided in a preferred embodiment that the cooling plates can be connected to the base body by means of press-joining.

It may be expedient if the fastening elements are constructed as projections, for example cylindrical projections, which preferably form a monolithic structure with the base body, and the counterpart elements are constructed as recesses, preferably through holes, corresponding to the projections.

In addition, it may be provided that the counterpart elements are constructed as for example cylindrical projections, which preferably form a monolithic structure with the cooling plates, and the fastening elements are constructed as recesses, preferably through holes, corresponding to the projections.

Furthermore, it may be provided that the cooling plates are arranged on the base body offset with respect to one another in a direction, which is preferably predetermined by the matrix, wherein the cooling plates are preferably arranged equidistantly from one another in a different direction, which is for example orthogonal to the predetermined direction.

The invention, together with further advantages is explained in more detail in the following on the basis of exemplary embodiments, which are shown in the drawing. In the figures FIGS. 1*a* and 1*b* show an exploded illustration of a heat sink;

In the following figures—insofar as not otherwise specified—the same reference numbers label the same features.

Figure 1A:
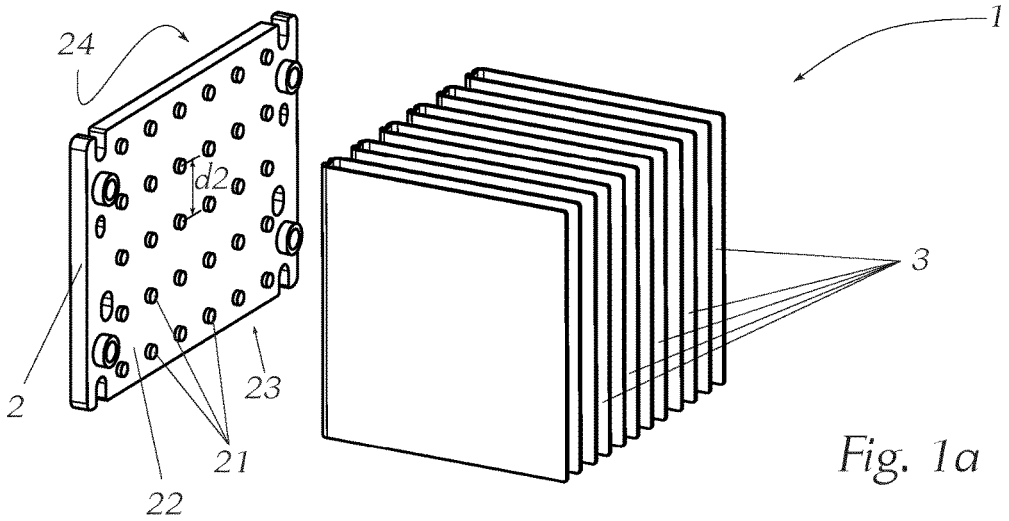
Figure 1B:
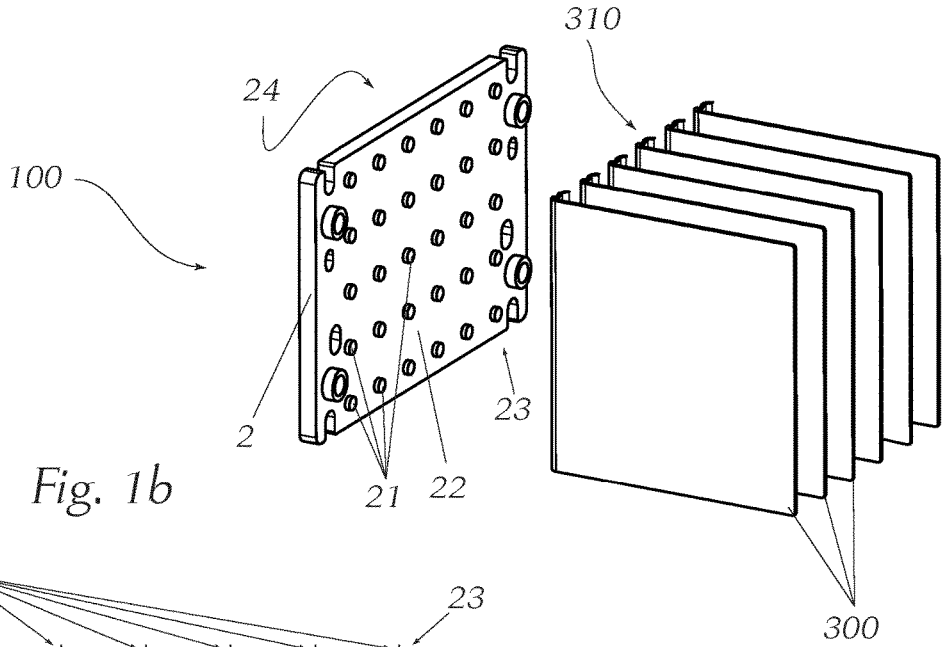

First, reference is made to FIGS. 1*a* and 1*b*. These respectively show a heat sink 1, 100 having a base body 2 and differently configured cooling plates 3, 300, which are arranged on the base body 2 and are in thermally conductive contact with the base body 2.

A heat sink 1, 100 of this type is advantageously used for cooling a light source (not shown), for example a semiconductor-based light source, particularly an LED light source of a light module (not shown) and can in this case be used as a support for this light source and, under certain circumstances, also for other elements which are provided for imaging light which is generated by the light source, such as reflectors, lens-supporting lens holders, objectives, etc. The previously mentioned light module can for example be installed in a motor vehicle headlamp or in a motor vehicle.

Both the base bodies 2 and the cooling plates 3, 300 are made from a thermally conductive material, preferably metal, for example from aluminium, such as Al99.5 or Al99.9. In this case, the term aluminium also includes aluminium alloys such as AlMg3. For example, it is conceivable that the base body 2 is constructed from Al99.5 or Al99.9 and the cooling plates 3, 300 are constructed from AlMg3.

Each cooling plate 3, 300 has a base side 31, 310. The base body 2 can be constructed as a plate. Identically constructed fastening elements 21 are for example arranged on a surface 22 of the base body 2 facing the base sides 31, 310. The base sides 31, 310 preferably lie in a plane arranged parallel to the surface 22 of the base body 2. Identically constructed counterpart elements 32, which correspond to the fastening elements 21, are for example arranged on each base side 31, 310. For example, the counterpart elements 32 can be arranged in a row along a longitudinal side of the base side 31, 310 of the respective cooling plate 3, 300. The fastening elements 21 engage into the counterpart elements 32.

In this case, the fastening elements 21 are arranged in a matrix 23. As mentioned, above, in connection with the present invention, the term "arranged in a matrix" is understood to mean a matrix-array-like arrangement, for example an arrangement in vertices of an imaginary two-dimensional, preferably regular, particularly square grid.

The counterpart elements 32 are arranged on the respective base sides 31, 310 at regular spacings d1 from one another, wherein the matrix 23 has a matrix spacing d2 between the—imaginary—matrix lines or between adjacent vertices of the imaginary grid or between the array elements of the matrix-array-like arrangement. The matrix spacing d2 is greater than the spacing d1 between the counterpart elements 32.

FIG. 1*a* shows an embodiment in which each cooling plate 3 is constructed in a U-shaped manner. In this case, each cooling plate 3 has two legs 33, which run substantially parallel to one another at a mutual spacing and are connected by means of a connecting web 31. In this embodiment, the base side is formed by the connecting web 31.

FIG. 1*b* shows an embodiment in which each cooling plate 300 is constructed in an L-shaped manner, wherein the base side is formed by a short side 310 of the L-shaped cooling plate 300.

Both the U- and the L-shaped cooling plates 3, 300 can be arranged on the base body 2 and connected to the same. For example, the short side 310 of the L-shaped cooling plate 300 and the connecting web 31 of the U-shaped cooling plate 300 can be constructed identically.

In a preferred embodiment, the spacing d1 between the counterpart elements 33 can be the same for all cooling plates 3, 300 and preferably be approximately half of the matrix spacing d2. In this case, the spacing d1 for example lies between 8 mm and 12 mm, preferably between 9 mm and 11 mm. In particular, the spacing d1 may lie between 9.5 mm and 10 mm, which facilitates the manufacturing of the base bodies 2 with fastening elements 21.

All cooling plates, for example U-shaped 3 or L-shaped 300 cooling plates, can be constructed identically.

The cooling plates 3, 300 can for example be connected to the base body 2 by means of press-joining or clinching.

A further surface 24 of the base body 2 is opposite the surface 22 having the fastening elements 21. It can be seen from FIG. 3 that the further surface 24 may have depressions 25 corresponding to the fastening elements 21, which depressions are created by using a tool, using which the fastening elements 21 are pressed. The number and/or the arrangement of the depressions 25 and the corresponding fastening elements 21 can be chosen such that the heat transfer is not impaired. Furthermore, the surface 24 can be used as a supporting surface for a circuit board with a number of LED light sources. The LED light sources can be arranged on the circuit board for example in a matrix array, such as a 2×3-, 3×3-, 3×4- or 4×4-array.

Figure 2:
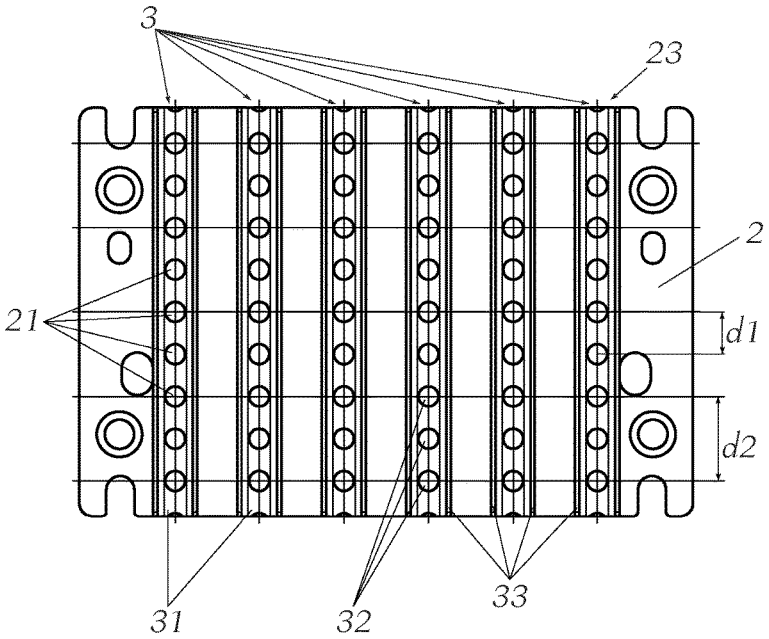
FIG. 2 shows a front view of the heat sink of FIG. 1*a;*
Figure 3:
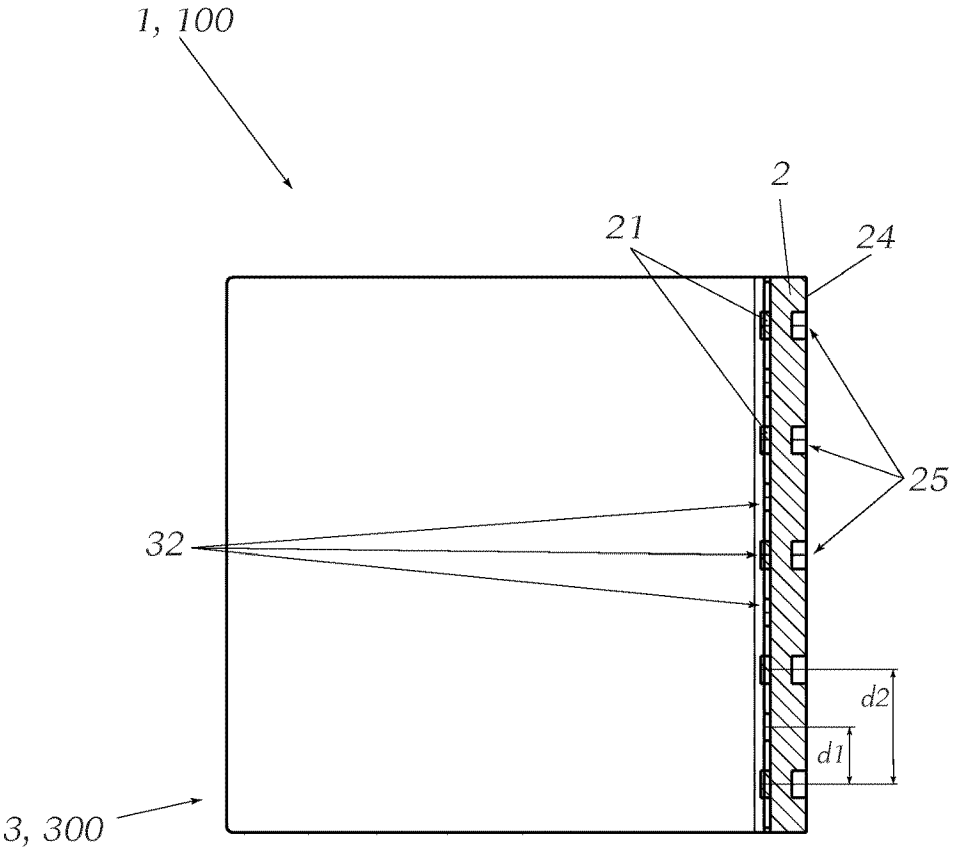
FIG. 3 shows a sectional illustration of the heat sink of FIG. 1*a* or 1*b*.

FIG. 2 shows a front view of the heat sink 1 of FIG. 1*a*, FIG. 3 shows a sectional illustration of the heat sink 1 of FIG. 1*a* or the heat sink 100 of FIG. 1*b*. It can be drawn from the FIGS. 1*a*, 1*b*, 2 and 3, that the fastening elements can be constructed as projections 21, which are cylindrical for example and which can form a monolithic structure with the base body 2. In this case, the counterpart elements can be constructed as recesses 32, preferably through holes, corresponding to the projections.

It is quite possible—this is not shown in the figures—that the counterpart elements are constructed as for example cylindrical projections, which preferably form a monolithic structure with the cooling plates. In this case, it is expedient if the fastening elements are constructed as recesses, preferably through holes, corresponding to the projections.

Figure 4:
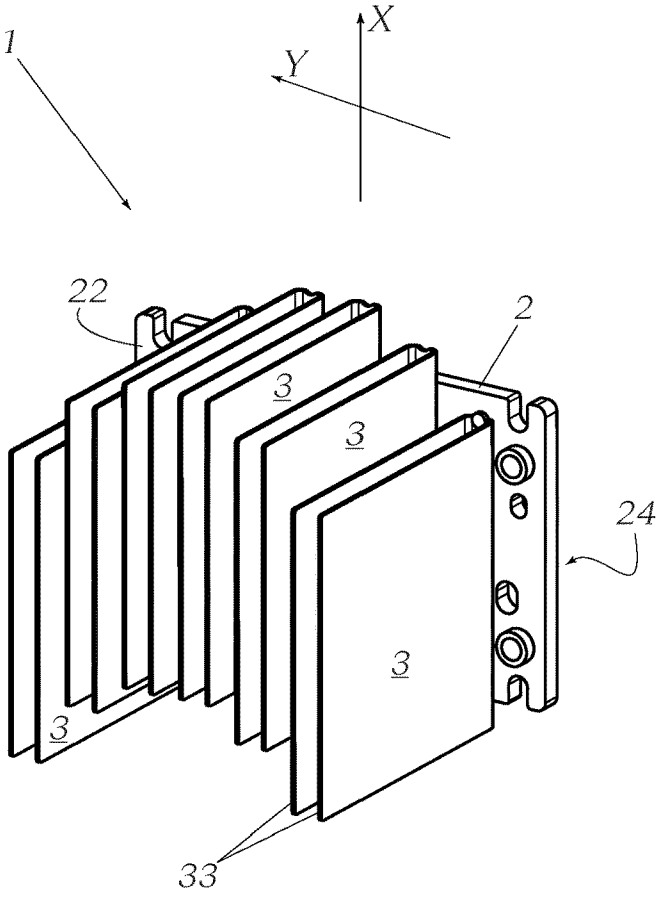
FIG. 4 shows an exploded illustration of a heat sink with cooling plates which are arranged offset.

It can be seen from FIG. 4 that the cooling plates 3 can be arranged on the base body 2 offset with respect to one another in a predetermined direction X. The direction X can for example be predetermined by the matrix 23. It is understood that the above-described matrix 23 predetermines two directions. These are the directions in which the matrix extends. It is however quite conceivable that the direction X deviates from the direction predetermined by the matrix 23. This can for example be rotated by 45° or 90° in the plane of the surface 22. It can furthermore be seen from FIG. 4 that the centrally arranged cooling plates protrude beyond an edge of the base body 2. Overall, the arrangement of the cooling plates 3 on the base body 2 has a curved course. Other arrangements of the cooling plates 3 on the base body 2 are also conceivable. Although the U-shaped cooling plates 3 can be seen clearly in FIG. 4, the L-shaped cooling plates 300 or cooling plates of a different shape can likewise be arranged offset on the base body 2.

The cooling plates 3, 300 are preferably arranged equidistantly from one another in a different direction Y, which is for example orthogonal to the predetermined direction X.

The object of the preceding description only consists in providing illustrative examples and specifying further advantages and characteristic features of the present invention. Thus, the preceding description cannot be interpreted as a limitation of the field of application of the invention or the patent rights claimed in the claims. In the preceding detailed description, various features of the invention are for example aggregated in one or more embodiments for the purpose of streamlining the disclosure. This type of disclosure is not to be understood to mean that it reflects the intention that the claimed invention requires more features than explicitly mentioned in each claim. Rather, as the following claims reflect, inventive aspects are present in fewer than all features of a single previously described embodiment.

Furthermore, although the description of the invention contains the description of one or more embodiments and certain variations and modifications, other variations and modifications lie within the scope of the invention, e.g. within the capabilities and knowledge of persons skilled in the art after understanding the present disclosure.

The reference numbers in the claims are used solely for better understanding of the present inventions and in no way mean a limitation of the present inventions.

The invention claimed is:

1. A heat sink (1, 100) for a light source of a motor vehicle light module, the heat sink (1, 100) comprising:

a base body (2); and cooling plates (3, 300) arranged on the base body (2), the cooling plates (3, 300) being configured to be in thermally conductive contact with the base body (2), each cooling plate (3, 300) having a base side (31, 310), the base body (2) having fastening elements (21) on a surface (22), which faces the base sides (31, 310) of the cooling plates (3, 300), counterpart elements (32), which correspond to the fastening elements (21), being arranged on each base side (31, 310), and the fastening elements (21) being constructed to engage into the counterpart elements (32), wherein the fastening elements (21) are arranged in a matrix (23), wherein the counterpart elements (32) are arranged on the respective base sides (31, 310) at regular spacings (d1) from one another and the matrix (23) has a matrix spacing (d2), which is greater than the spacing (d1) between the counterpart elements (32);

wherein the fastening elements are arranged in vertices of a two-dimensional square grid and the base sides of the cooling plates are constructed separately from one another, wherein the spacing (d1) between the counterpart elements (32) is the same for all cooling plates (3, 300) and is approximately half of the matrix spacing (d2), and wherein the cooling plates (3, 300) are arranged on the base body (2) offset with respect to one another in a direction (X), which is predetermined by the matrix (23), wherein the cooling plates (3, 300) are arranged equidistantly from one another in a different direction (Y).

2. The heat sink according to claim 1, wherein each cooling plate (3) is constructed in a U-shaped manner and has two legs (33), which run substantially parallel to one another at a mutual spacing and are connected by a connecting web, wherein the connecting web forms the base side (31).

3. The heat sink according to claim 1, wherein each cooling plate (300) is constructed in an L-shaped manner, wherein the base side is formed by a short side (310) of the L-shaped cooling plate.

4. The heat sink according to claim 1, wherein all cooling plates (3, 300) are constructed identically.

5. The heat sink according to claim 1, wherein all cooling plates (3, 300) are connected to the base body (2) by press-joining.

6. The heat sink according to claim 1, wherein the fastening elements are constructed as projections (21) and the counterpart elements are constructed as recesses (32) corresponding to the projections.

7. The heat sink according to claim 6, wherein the fastening elements form a monolithic structure with the base body (2).

8. The heat sink according to claim 6, wherein the projections (21) are cylindrical projections, and the counterpart elements are through-holes.

9. The heat sink according to claim 1, wherein the counterpart elements are constructed as projections and the fastening elements are constructed as recesses corresponding to the projections.

10. The heat sink according to claim 9, wherein the counterpart elements form a monolithic structure with the cooling plates.

11. The heat sink according to claim 9, wherein the counterpart elements are cylindrical projections, and the fastening elements are constructed as through-holes.

12. A motor vehicle light module or motor vehicle headlamp light module comprising at least one heat sink according to claim 1.

13. A motor vehicle headlamp comprising at least one motor vehicle headlamp light module or motor vehicle light module according to claim 12.

14. The heat sink according to claim 1, wherein the different direction (Y) is orthogonal to the direction (X).

* * * * *